United States Patent [19]

Ng

[11] Patent Number: 4,536,458

[45] Date of Patent: Aug. 20, 1985

[54] MIGRATION IMAGING SYSTEM

[75] Inventor: Dominic S. Ng, Toronto, Canada

[73] Assignee: Xerox Corporation, Stamford, Conn.

[21] Appl. No.: 567,838

[22] Filed: Jan. 3, 1984

[51] Int. Cl.[3] ..... G03G 5/04; G03G 13/22

[52] U.S. Cl. ..... 430/41; 430/67; 430/96

[58] Field of Search ..... 430/41, 96

[56] References Cited

U.S. PATENT DOCUMENTS

| | | | |
|---|---|---|---|
| 3,795,512 | 12/1967 | Knieser | 430/41 |
| 3,873,309 | 3/1975 | Goffe | 430/41 |
| 3,909,262 | 9/1975 | Goffe et al. | 430/41 |
| 3,933,491 | 1/1976 | Goffe et al. | 430/41 |
| 3,954,464 | 5/1976 | Karam et al. | 430/58 |
| 3,975,195 | 8/1976 | Goffe | 430/41 |
| 3,982,938 | 9/1976 | Honjo et al. | 96/1.5 |
| 4,072,517 | 2/1978 | Goffe et al. | 430/41 |
| 4,101,321 | 7/1978 | Levy et al. | 430/41 |
| 4,102,682 | 7/1978 | Goffe et al. | 430/41 |
| 4,265,990 | 5/1981 | Stolka et al. | 430/59 |

*Primary Examiner*—Roland E. Martin

*Attorney, Agent, or Firm*—Peter H. Kondo

[57] ABSTRACT

This invention relates to a migration imaging member comprising a substrate and an electrically insulating softenable layer on said substrate, said softenable layer comprising migration marking material located at least at or near the surface of said softenable layer spaced from said substrate and a charge transport molecule.

14 Claims, 5 Drawing Figures

MIGRATION IMAGING SYSTEM

BACKGROUND OF THE INVENTION

This invention relates generally to migration imaging, and more specifically to an improved migration imaging member and processes for using the member.

Migration imaging systems capable of producing high quality images of high density, continuous tone and high resolution, have been developed. Such migration imaging systems are disclosed, for example, in U.S. Pat. No. 3,909,262 which issued Sept. 30, 1975 and U.S. Pat. No. 3,975,195 which issued Aug. 17, 1976, the disclosures of both being incorporated herein in their entirety. In a typical embodiment of migration imaging systems, an imaging member comprising a substrate, a layer of softenable material, and photosensitive marking material is imaged by first forming a latent image by electrically charging the member and exposing the charged member to a pattern of activating electromagnetic radiation such as light. Where the photosensitive marking material was originally in the form of a fracturable layer contiguous the upper surface of the softenable layer, the marking particles in the exposed area of the member migrate in depth toward the substrate when the member is developed by softening the softenable layer.

The expression "softenable" as used herein is intended to mean any material which can be rendered more permeable thereby enabling particles to migrate through its bulk. Conventionally, changing the permeability of such material or reducing its resistance to migration of migration making material is accomplished by dissolving, swelling, melting or softening, by techniques, for example, such as contacting with heat, vapors, partial solvents, solvent vapors, solvents and combinations thereof, or by otherwise reducing the viscosity of the softenable material by any suitable means.

The expression "fracturable" layer or material as used herein, means any layer or material which is capable of breaking up during development, thereby permitting portions of said layer to migrate toward the substrate or to be otherwise removed. The fracturable layer may be particulate, semi-continuous, or microscopically discontinuous in various embodiments of the migration imaging members of the present invention. Such fracturable layers of marking material are typically contiguous to the surface of the softenable layer spaced apart from the substrate, and such fracturable layers may be substantially or wholly embedded in the softenable layer in various embodiments of the imaging members of the inventive system.

The expression "contiguous" as used herein is intended to mean in actual contact; touching; also, near, though not in contact; and adjoining, and is intended to generically describe the relationship of the fracturable layer of marking material in the softenable layer, vis-a-vis, the surface of the softenable layer spaced apart from the substrate.

The expression "sign retained" as used herein is intended to mean that the dark (higher optical density) and light (lower optical density) areas of the image formed on the migration imaging member correspond to the dark and light areas of the image on the original.

The expression "sign reversed" as used herein is intended to mean that the dark areas of the image formed on the migration imaging member correspond to the light areas of the image on the original and the light areas of the image formed on the migration imaging member correspond to the dark areas of the image on the original.

The expression "contrast density" as used herein is intended to mean the difference between maximum optical density ($D_{max}$) and minimum optical density ($D_{min}$) of an image. Optical density is measured for the purpose of this application by diffuse densitometers with a blue Wratten No. 94 filter. The expression "optical density" as used herein is intended to mean "transmission optical density" and is represented by the formula:

$$\log_{10} [I_o/I]$$

where I is the transmitted light intensity and $I_o$ is the incident light intensity. While contrast density is measured by diffuse densitometers in this application, it should be noted that measurement by specular densitometers gives substantially similar results.

There are various other systems for forming such images, where non-photosensitive or inert marking materials are arranged in the aforementioned fracturable layers, or dispersed throughout the softenable layer, as described in the aforementioned patent, which also discloses a variety of methods which may be used to form latent images upon migration imaging members.

Various means for developing the latent images in the novel migration imaging system may be used. These development methods include solvent wash-away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash-away or meniscus development method, the migration marking material in the light-struck region migrates toward the substrate through the softenable layer, which is softened and dissolved, and repacks into a more or less monolayer configuration. This region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore the image-sense of the developed image is sign-reversed, i.e. positive to negative or vice versa. Various methods and materials and combinations thereof have previously been used to fix such unfixed migration images. In the other previously described heat or vapor development techniques, the softenable layer remains substantially intact after development, with the image being self-fixed because the marking material particles are trapped within the softenable layer. In the heat, or vapor softening developing modes, the migration marking material in the light-struck region disperses in the depth of the softenable layer after development and this region exhibits $D_{min}$ which is typically in the range of 0.6–0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. This region thus exhibits maximum optical density ($D_{max}$). Therefore, the image sense of the heat or vapor developed images is sign-retaining, i.e. positive-to-positive or negative-to-negative.

Techniques have been devised to permit sign-reversed imaging with vapor development, but these techniques are generally complex and require critically controlled processing conditions. Such technique is described, for example, in U.S. Pat. No. 3,795,512.

For many imaging applications, such as a lithographic intermediate film in the graphic arts industry, it is desirable to produce negative images from a positive original or positive images from a negative original i.e. sign-reversing imaging, preferably with low minimum optical density. Although the meniscus or solvent wash-away development method produces sign-reversed images with low minimum optical density, it involves removal of materials from the migration imaging member, leaving the migration image largely or totally unprotected from abrasion. Although various methods and materials have previously been used to overcoat such unfixed migration images, the post-development overcoating step is impractically costly and inconvenient for the end users. Additionally, disposal of the effluents washed from the film during development is very costly. While heat or vapor development methods are preferred because they are rapid, essentially dry and produce no effluents the image sense of the heat or vapor developed images is sign-retaining and the minimum optical density is quite high. Therefore, there is a continuing need for a simple, inexpensive, and usable imaging member capable of sign-reversing imaging with essentially dry development methods and preferbly giving low minimum density.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the film and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when the objects are separated.

The sensitivity to abrasion and foreign contaminants can be reduced by forming an overcoating such as the overcoatings described in the aforementioned U.S. Pat. No. 3,909,262. However, because the migration imaging mechanisms for each development method are difficult and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles etc., application of an overcoat to the softenable layer often causes changes in the delicate balance of these processes, and results in degraded photographic characteristics compared with the non-overcoated migration imaging member. Notably, the photographic contrast density is degraded.

In addition, many overcoatings do not prevent blocking when migration imaging members are stacked or wound into rolls. In addition, for applications where migration imaging members are utilized for composing lithograhic intermediates wherein imaged migration imaging members are temporarily secured by adhesive tape to a substrate and thereafter reused, very often the migration imaging member is damaged by removal of the adhesive tape and is rendered unsuitable for reuse. This damage generally takes two forms. First, many overcoats do not adhere well to the softenable layer of the migration imaging member and can be separated by flexing or easily separated or removed entirely from the softenable layer upon removal of the adhesive tape, thereby eliminating further abrasion resistance. Secondly, the softenable layer which contains the photoactive particles often separates from the substrate upon removal of the adhesive tape. Therefore, the overcoat should not only adhere weli to the softenable layer but should also have abhesive properties to release the adhesive tape to prevent damage to the migration imaging member.

Therefore, there continues to be a need for improved migration imaging members. Additionally, there is a need for improved migration imaging members capable of producing sign-reversed images with dry development, which possess high contrast density, exhibit greater resistance to the adverse effects of finger prints, blocking, softenable layer/overcoating layer interface failure, and abrasion, and can survive adhesive tape tests.

SUMMARY OF THE INVENTION

It is an object of the present invention to provide an improved migration imaging member which overcomes the above-noted disadvantages and satisfies the above noted objectives.

It is another object of the present invention to provide a simple, reliable, dry process for imaging an improved migration imaging member which produces excellent sign-reversed migration images having high contrast density.

It is yet another object of the present invention to provide an improved migration imaging member which possesses tolerance to abrasion, minimizes blocking, is insensitive to fingerprints and possesses good surface release properties.

It is yet another object of the present invention to provide an improved migration imaging member having ambipolar characteristics capable of producing sign retaining or sign reversing images by appropriate choice of processing conditions.

These and other objects of the present invention are accomplished by providing an improved migration imaging member comprising a substrate, an electrically insulating softenable layer on the substrate, the softenable layer comprising a charge transport material, and migration marking material located at least at or near the surface of the softenable layer spaced from the substrate.

Also included within the scope of the present invention is an imaging method comprising providing a migration imaging member comprising a substrate and an electrically insulating softenable layer on the substrate, the softenable layer comprising a charge transport material, and migration marking material located at least at or near the surface of the softenable layer spaced from the substrate, electrostatically charging the migration imaging member, exposing the member to activating radiation in an imagewise pattern and developing the member by decreasing the resistance to migration of marking material in depth in the softenable layer at least sufficient to allow migration of marking material whereby marking material migrates toward the substrate in image configuration.

BRIEF DESCRIPTION OF THE DRAWINGS

For a better understanding of the present invention, and further features thereof, reference is made to the following detailed description of various preferred embodiments wherein.

Figure 1:
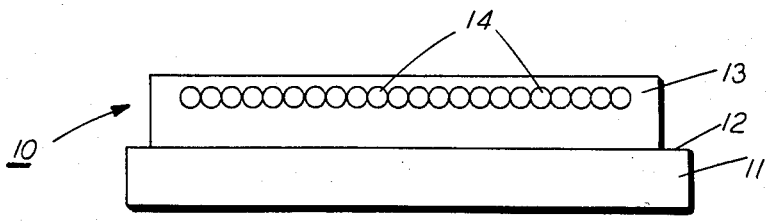
FIG. 1 is a partially schematic, cross-sectional view of a typical layered configuration migration imaging member.

These figures merely schematically illustrate the invention and are not intended to indicate relative size and dimensions of actual imaging members or components thereof.

DESCRIPTION OF THE PREFERRED EMBODIMENTS

Migration imaging members typically suitable for use in the migration imaging processes described above are illustrated in FIGS. 1 and 2. In the migration imaging member 10 illustrated in FIG. 1, the member comprises substrate 11 having a layer of softenable material 13 coated thereon, the layer of softenable material 13 having a fracturable layer of migration marking material 14 contiguous with the upper surface of softenable layer 13. Particles of marking material 14 appear to be in contact with each other in the Figures due to the physical limitations of such schematic illustrations. The particles of marking material 14 are actually spaced less than a micrometer apart from each other. In the various embodiments, the supporting substrate 11 may be either electrically insulating or electrically conductive. In some embodiments the electrically conductive substrate may comprise a supporting substrate 11 having a conductive coating 12 coated onto the surface of supporting substrate 11 upon which the softenable layer 13 is also coated. The substrate 11 may be opaque, translucent, or transparent in various embodiments, including embodiments wherein the electrically conductive layer 12 coated thereon may itself be partially or substantially transparent. The fracturable layer of marking material 14 contiguous the upper surfce of the softenable layer 13 may be slightly, partially, substantially or entirely embedded in softenable material 13 at the upper surface of the softenable layer.

Figure 2:
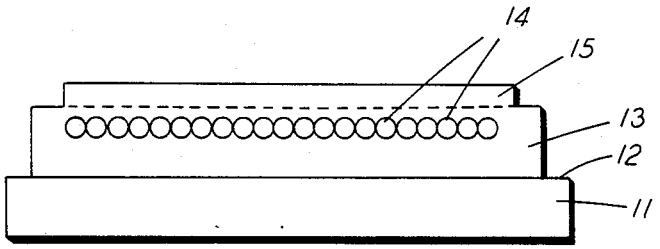
FIG. 2 is a partially schematic, cross-sectional view of an overcoated migration imaging member.

In FIG. 2, a multi-layered overcoated embodiment of the present invention is shown wherein supporting substrate 11 has conductive coating 12 and a layer of softenable material 13 coated thereon. The migration marking material 14 is initially arranged in a fracturable layer contiguous the upper surface of softenable material layer 13. In the embodiment illustrated in FIG. 2, the migration imaging member also includes an advantageous overcoating layer 15 which is coated over the softenable layer 13. In the various embodiments of the novel migration imaging member of this invention, the overcoating layer 15 may comprise an abhesive or release material or may comprise a plurality of layers in which the outer layer comprises an abhesive or release material.

Material suitable for use as substrate 11, conductive coating 12, softenable layer 13, and migration marking materials 14 are the same materials disclosed in U.S. Pat. No. 3,909,262 which is incorporated by reference herein in its entirety. As stated above, the substrate 11 may be opaque, translucent, transparent, electrically insulating or electrically conductive. Similarly, the substrate and the entire migration imaging member which it supports may be in any suitable form including a web, foil, laminate or the like, strip, sheet, coil, cylinder, drum, endless belt, endless moebius strip, circular disc or other shape. The present invention is particularly suitable for use in any of these configurations.

The conductive coating 12 may, like substrate 11, be of any suitable shape. It may be a thin vacuum deposited metal or metal oxide coating, a metal foil, electrically conductive particles dispersed in a binder and the like. Typical metals and metal oxides include aluminum, indium, gold, tin oxide, indium tin oxide, silver, nickel, and the like.

In various modifications of the novel migration imaging members of the present invention, the migration marking material is preferably electrically photosensitive or of any other combination of materials suitable for use in migration imaging systems. Typical migration marking materials are disclosed, for example, in U.S. Pat. No. 3,909,262 which issued Sept. 30, 1975 and U.S. Pat. No. 3,975,195 which issued Aug. 17, 1976, the disclosures of both being incorporated herein in their entirety. Examples of migration marking materials include selenium, selenium-tellurium alloys, other selenium alloys, phthalocyanines and the like.

The softenable material 13 may be any suitable material which may be softenable by liquid solvents, solvent vapors, heat or combinations thereof. In addition, in many embodiments of the migration imaging member the softenable material 13 is typically substantially electrically insulating and does not chemically react during the migration force applying and developing steps of the present invention. It should be noted that, if conductive layer 12 is not utilized, layer 11 should preferably be substantially electrically conductive for the preferred modes thereof of applying electrical migration forces to the migration layer. Although the softenable layer has been described as coated on a substrate, in some embodiments, the softenable layer may itself have sufficient strength and integrity to be substantially self-supporting and may be brought into contact with a suitable substrate during the imaging process.

Any suitable swellable, softenable material may be utilized in layer 13. Typical swellable, softenable layers include styrene-acrylate copolymers, polystyrenes, alkyd substituted polystyrenes, styreneolefin copolymers, styrene-co-n-hexylmethacrylate, a custom synthesized 80/20 mole percent copolymer of styrene and hexylmethacrylate having an intrinsic viscosity of 0.179 dl/gm; other copolymers of styrene and hexylmethacrylate, styrene-vinyltoluene copolymer, polyalphamethylstyrene, co-polyesters, polyesters, polyurethanes, polycarbonates, co-polycarbonates, mixtures and copolymers thereof. The above group of materials is not intended to be limiting, but merely illustrative of materials suitable for such softenable layers.

Any suitable charge transport molecule capable of acting as a softenable layer material or which is soluble or dispersible on a molecular scale in the softenable layer material may be utilized in the softenable layer of this invention. The charge transport molecule is defined as an electrically insulating film-forming binder or a soluble or molecularly dispersable material dissolved or molecularly dispersed in an electrically insulating film-forming binder which is capable of increasing the degree of charge transport between the migration imaging particles and electrical ground prior to or in the early stages of development for at least one sign of charge compared to electrically inert matrices. In other words, the charge transport molecule must at least increase the degree of charge injection (for at least one sign of charge) from migration imaging particles to the softenable layer matrix and it may also improve charge transport through the matrix to electrical ground. The charge transport molecules may be hole transport molecules or electron transport molecules. Where the charge transport molecule is to be dissolved or molecularly dispersed in an insulating film-forming binder, the combination of the charge transport molecule and the insulating film-forming binder should be such that the charge transport molecule may be incorporated into the film-forming binder in sufficient concentration levels while still remaining in solution or molecularly dispersed. If desired, the insulating film-forming binder need not be utilized where the charge transport molecule is a polymeric film-forming material.

Any suitable charge transporting molecule may be used. Charge transporting materials are well known in the art. Typical charge transporting materials include the following:

Diamine transport molecules of the type described in U.S. Pat. Nos. 4,306,008, 4,304,829, 4,233,384, U.S. Pat. No. 4,115,116, U.S. Pat. No. 4,299,897 and U.S. Pat. No. 4,081,274. Typical diamine transport molecules include N,N'-diphenyl-N,N'-bis(3''-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)-pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)-pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Pat. Nos. 1,058,836, 1,060,260 and 1,120,875.

Hydrazone transport molecules such as p-diethylamino benzaldehyde-(diphenyl hydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldeyde 1-methyl-1-phenylhydrazone and the like Other typical hydrazone transport molecules are described, for example in U.S. Pat. No. 4,150,987, U.S. Pat. No. 4,385,106, U.S. Pat. No. 4,338,388 and U.S. Pat. No. 4,387,147.

Carbazole phenyl hydrazone transport molecules such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described, for example, in U.S. Pat. No. 4,256,821 and U.S. Pat. No. 4,297,426.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butylnaphthalimide as described, for example, in U.S. Pat. No. 3,972,717.

Oxadiazole derivatives such as 2,5-bis-(p-diethylaminophenyl)-oxadiazole-1,3,4 described in U.S. Pat. No. 3,895,944.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989.

9-fluorenylidene methane derivatives having the formula:

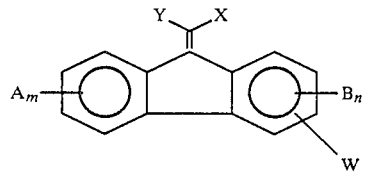

wherein X and Y are cyano groups or alkoxycarbonyl groups, A, B, and W are electron withdrawing groups independently selected from the group consisting of acyl, alkoxycarbonyl, nitro, alkylaminocarbonyl and derivatives thereof, m is a number of from 0 to 2, and n is the number 0 or 1 as described in copending in U.S.

patent application Ser. No. 521,198, entitled Layered Photoresponsive Device, filed on Aug. 8, 1983. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric or non-polymeric transport materials as described in U.S. Pat. No. 3,870,516.

The disclosures of each of the patents and pending patent application identified above pertaining to charge transport molecules which are soluble or dispersible on a molecular scale in a film forming binder are incorporated herein in their entirety.

When the charge transport molecules are combined with an insulating binder to form the softenable layer, the amount of charge transport molecule which is used may vary depending upon the particular charge transport material and its compatibility (e.g. solubility) in the continuous insulating film forming binder phase of the softenable matrix layer and the like. Satisfactory results have been obtained using between about 2 percent to about 50 percent by weight charge transport molecule based on the total weight of the softenable layer. A particularly preferred charge transport molecule is one having the general formula:

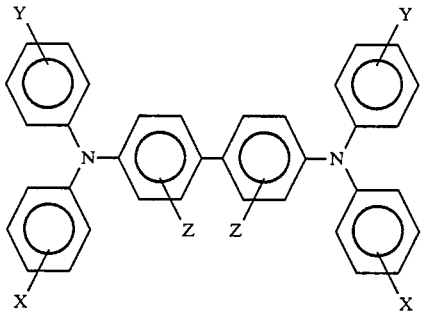

wherein X, Y and Z are selected from the group consisting of hydrogen, an alkyl group having from 1 to about 20 carbon atoms and chlorine and at least one of X, Y and Z is independently selected to be an alkyl group having from 1 to about 20 carbon atoms or chlorine. If Y and Z are hydrogen, the compound may be named N,N'-diphenyl-N,N'-bis(alkylphenyl)-[1,1'-biphenyl]-4,4'-diamine wherein the alkyl is, for example, methyl, ethyl, propyl, n-butyl, etc. or the compound may be N,N'-diphenyl-N,N'-bis(chlorophenyl)-[1,1'-biphenyl]-4,4'-diamine. Excellent results may be obtained when the softenable layer contains between about 5 percent to about 20 percent by weight of these diamine compounds based on the total weight of the softenable layer. Optimum results are achieved when the softenable layer contains between about 8 percent to about 12 percent by weight of N,N'-diphenyl-N,N'-bis(3''-methylphenyl)-(1,1'-biphenyl)-4,4'-diamine based on the total weight of the softenable layer. Generally, when the diamine concentration in the softenable layer is either too low or too high, loss of contrast density is observed. Moreover, very large concentrations of these diamine compounds may cause crystallization of the compounds in the softenable layer.

The charge transport molecule can be incorporated into the softenable layer by any suitable technique. For example, it may be mixed with the softenable layer components by dissolution in a common solvent. If desired, a mixture of solvents for the charge transport molecule and softenable layer may be used to facilitate mixing and coating.

The charge transport molecule and softenable layer mixture may be applied to the substrate by any conventional coating process. Typical coating processes include draw bar, spraying, extrusion, dip, gravure roll, wire-wound rod, air knife coating and the like. The thickness of the deposited softenable layer after any drying or curing step is preferably in the range of about 0.7–2.5 micrometers. Slightly thinner layers may be used at the expense of a slight increase in $D_{min}$, because sufficient room is required for particle migration. Thicker layers may be utilized, but the time required for removal of solvents may become impractical and the trapped solvent in the layer may cause blocking.

Incorporation of the charge transport molecule into the softenable layer imparts to the migration imaging member the ability to form sign-reversed images using very simple processing steps, involving only a single charging step.

In FIG. 2, the overcoating layer 15 may be substantially electrically insulating, electrically conductive, photosensitive, photoconductive, photosensitively inert, or have any other desirable properties. The overcoating 15 may also be transparent, translucent or opaque, depending upon the imaging system in which the overcoated member is to be used. The overcoating layer 15 is continuous and preferably of a thickness up to about 5 to 10 micrometers, although thicker overcoating layers may be suitable and desirable in some embodiments. For example, if the overcoating layer is electrically conductive, there are virtually no limitations on thickness, except for the practical ones of handling and economics. Preferably, the overcoating should have a thickness of at least about 0.1 micrometer and optimally, at least about 0.5 micrometer. Where the overcoating layer is electrically insulating and greater than about 5 to 10 micrometers thick, undesirably high electrical potentials may have a greater tendency to build up upon the imaging member during processing and migration imaging. Insulating overcoatings of between about 1 micrometer and about 5 micrometers are preferred to minimize charge trapping in the bulk of the overcoating layer 15. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer 15 should protect the softenable layer 13 in order to provide greater resistance to the adverse effects of abrasion. The overcoating layer 15 may adhere strongly to the softenable layer 13 to assist the migration imaging member to survive adhesive tape removal without damage. The overcoating layer 15 may also have abhesive properties at its outer surface which provide improved insensitivity to fingerprints and blocking, and which further improve the capability of the migration imaging member to withstand adhesive tape removal. The abhesive properties may be inherent in the overcoating layer 15 or may be imparted to the overcoating layer 15 by incorporation of another layer or component of abhesive material. These abhesive materials should not degrade the film forming components of the overcoating and should preferably have a surface energy of less than about 20 ergs/cm$^2$. Typical abhesive materials include fatty acids, salts and esters, fluorocarbons, silicones and the like. The coatings may be applied by any suitable technique such as draw bar, spray, dip, melt, extrusion or gravure coating. It will be appreciated that these overcoating layers protect the migration imaging members before imaging, during imaging and (with other than liquid development techniques) after the members have been imaged.

Figure 3A:
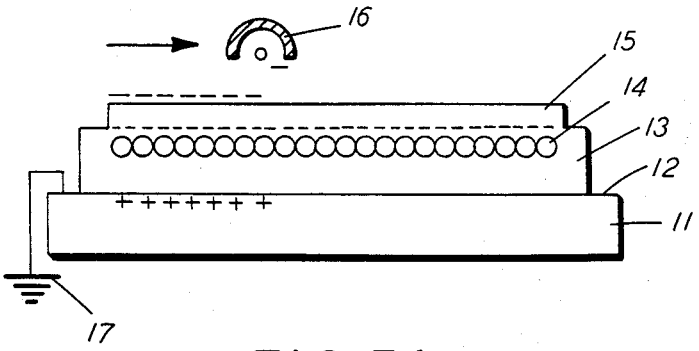
FIGS. 3A, 3B, and 3C are partially schematic, cross-sectional views, of the process steps to form migration images in one embodiment of the present invention.
Figure 3B:
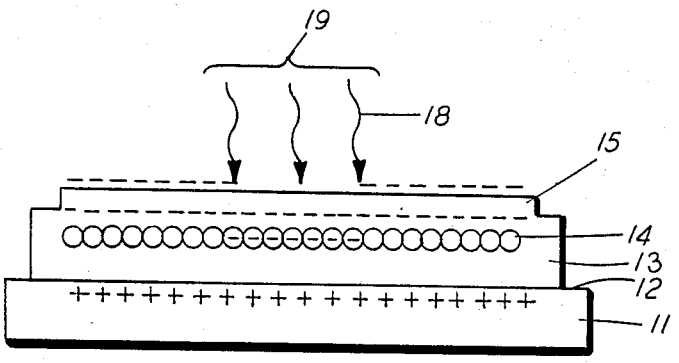
Figure 3C:
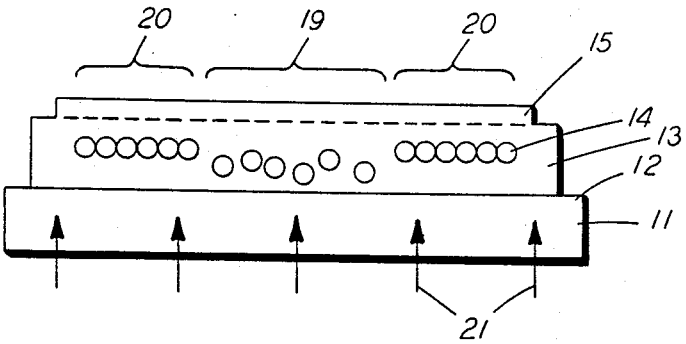

The improved imaging members of the present invention described above are useful in the imaging process illustrated in FIGS. 3A, 3B and 3C. The imaging steps in the process using the novel imaging members of the present invention typically comprise the steps of forming an electrical latent image on the imaging member and developing the latent image by decreasing the resistance of the softenable material to allow migration of the particulate marking material through the softenable layer 13 whereby migration marking material is allowed to migrate in depth in softenable material layer 13 in an imagewise configuration as shown in FIGS. 3A, 3B and 3C. The imaging member illustrated in FIGS. 3A, 3B and 3C is a layered configuration imaging member like that illustrated in FIG. 2.

When the migration marking material or softenable material is an electrically photosensitive material, the electrical latent image may be formed on the imaging member by uniformly electrostatically charging the member and then exposing the charged member to activating electromagnetic radiation in an imagewise pattern prior to substantial dark decay of said uniform charge. Satisfactory results may be obtained if the dark decay is less than about 50 percent of the initial charge, thus the expression "substantial decay" is intended to mean a dark decay is less than 50 percent of the initial charge. A dark decay of less than about 25 percent of the initial charge is preferred for optimum imaging. The charging and exposing steps are illustrated in FIGS. 3A and 3B. In FIG. 3A, the imaging member of the present invention comprising substrate 11 having conductive coating 12 thereon, softenable layer 13, a fracturable layer of marking material 14 contiguous the surface of the softenable layer 13 and overcoating 15 thereon is shown being electrostatically naegatively charged with corona charging device 16. Where substrate 11 is conductive or has a conductive coating 12, the conductive layer is grounded as shown at 17 or maintained at a predetermined potential during electrostatic charging. Another method of electrically charging a member having an insulating rather than a conductive substrate is to electrostatically charge both sides of the member to surface potentials of opposite polarities. In FIG. 3B, the charged member is shown being exposed to activating electromagnetic radiation 18 in area 19 thereby forming an electrical latent image upon the imaging member.

The member having the electrical latent image thereon is then developed by decreasing the resistance of the softenable material to migration of the particulate marking material, through the softenable layer 13 as shown in FIG. 3C by application of heat shown radiating into the softenable material at 21 to effect softening. The application of heat, solvent vapors, or combinations thereof, or any other means for decreasing the resistance of the softenable material of softenable layer 13 to allow migration of the migration marking material may be used to develop a latent image by allowing migration marking material 14 to migrate in depth in softenable layer 13 in imagewise configuration. In FIG. 3C, the migration marking material is shown migrated in area 19 (the exposed region) and in its initial, unmigrated state in areas 20 (the unexposed region). The areas 19 and 20 correspond to the formation of the electric latent image described in conjunction with FIGS. 3A and 3B. The migrated, imaged member illustrated in FIG. 3C is shown with the overcoating layer 15 thereon. This overcoating layer 15 protects the imaging member prior to, during and after imaging. If desired, an uncoated imaging member like that illustrated in FIG. 1 may be substituted for the coated imaging member illustrated in FIG. 2.

In the development step illustrated in FIG. 3C, the imaging member is typically developed by uniformly heating the structure to a relatively low temperature. For example, at a temperature of 110° C. to about about 130° C., heat need only be applied for a few seconds. For lower heating temperatures, more heating time may be required. When the heat is applied, the softenable layer 13 decreases in viscosity thereby decreasing its resistance to migration of the marking material in depth through the softenable layer and, as shown in FIG. 3C, migrating in the exposed area 19.

If desired, solvent vapor development may be substituted for the heat development step shown in FIG. 3C. Vapor development of migration imaging members is well known in the art. A preferred solvent utilized for solvent vapor development is toluene with vapor exposure for between about 4 seconds and about 60 seconds at a solvent vapor partial pressure of between about 5 millimeters and 30 millimeters of mercury.

The imaging members illustrated in FIGS. 1 and 2 may also be imaged by uniform solvent vapor pretreatment, uniform charging, imagewise exposure, and heat development. The vapor exposure time depends upon factors such as the solubility of softenable layer in the solvent, the type of solvent vapor, the ambient temperature and the concentration of the solvent vapors. Moreover, the presence or absence of an overcoating on the softenable layer can affect the vapor exposure time. Satisfactory results have been achieved with vapor exposure times of between about 10 seconds and about 2 minutes at 21° C. and development heating temperatures between about 100° C. and about 120° C. for 2 seconds to 2 minutes, and with solvent vapor partial pressures of between about 20 mm of mercury and about 80 mm of mercury when the solvent is n-ethyl acetate and the uncoated softenable layer contains a custom synthesized 80/20 mole percent copolymer of styrene and hexylmethacrylate having an intrinsic viscosity of 0.179 dl/gm and N,N'-diphenyl-N,N'-bis(3''-methylphenyl)-(1,1'-biphenyl)-4,4'-diamine. The test for a satisfactory combination of time, temperature and vapor concentration is maximized contrast density.

Depending upon the specific imaging system used, including the specific imaging structure, materials, process steps, and other parameters, the imaging member of the present invention may produce positive images from positive originals as illustrated in FIGS. 3A, 3B and 3C or negative images from positive originals.

The invention will now be described in detail with respect to specific preferred embodiments thereof, it being noted that these examples are intended to be illustrative only and are not intended to limit the scope of the present invention. Parts and percentages are by weight unless otherwise indicated.

EXAMPLE I

An imaging member similar to that illustrated in FIG. 1 was prepared by dissolving about 13 percent by weight of 80/20 mole percent copolymer of styrene and hexylmethacrylate and about 1.0 percent by weight of N,N'-diphenyl-N,N'-bis(3''-methylphenyl)-(1,1'-biphenyl)-4,4'-diamine in about 86 percent by weight toluene all based on the total weight of the solution. The solution was applied by means of a Dilts coater onto a 12 inch wide 3 mil Mylar polyester film (available from E. I. duPont deNemours Co.) having a thin, semitransparent aluminum coating. The deposited softenable layer was allowed to dry at about 110° C. for about 15 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vaccum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting imaging member had a very uniform optical density with no signs of microcrystals or aggregates. The migration imaging member was thereafter imaged and developed by vapor processing techniques comprising the steps of corotron charging to a surface potential of about +180 volts, exposing to activating radiation through a step-wedge and developing with toluene vapor by immersing for 5 seconds in vapor above a liquid bath in an enclosed chamber equipped with a sliding door and fan. A sign reversed image having excellent image quality and a contrast density of about 1.23 ($D_{max}$ about 1.90, $D_{min}$ about 0.67) was obtained. The $D_{max}$ area (light exposed) is due to the unmigrated subsurface selenium particles and the $D_{min}$ area (unexposed) is due to migrated subsurface selenium particles dispersed in the polymer matrix. The sign reversed image was stable when stored under normal ambient conditions.

EXAMPLE II

A fresh imaging member was prepared as described in Example I. The resulting migration imaging member was thereafter imaged and developed by vapor processing techniques comprising the steps of corotron charging to a surface potential of about −80 volts, exposing to activating radiation through a step-wedge and developing by toluene vapor as in Example I. Contrast density of the imaged member was about 1.1 ($D_{max}$ about 1.85, $D_{min}$ about 0.75) when the time interval between charging and exposure was less than about two minutes. The resulting sign-retained imaged migration imaging member exhibited excellent image quality. The $D_{max}$ area (unexposed) is due to the unmigrated subsurface selenium particles and the $D_{min}$ area (light exposed) is due to migrated subsurface selenium particles dispersed in the polymer matrix. The sign-retained image was stable when stored under normal ambient conditions. Although negative or positive charged-vapor developed images can also be demonstrated with no N,N'-diphenyl-N,N'-bis(3''-methylphenyl)-(1,1'-biphenyl)-4,4'-diamine dissolved in the copolymer using development with Freon TMC vapor, such images are always sign-retained; the presence of N,N'-diphenyl-N,N'-bis(-3''-methylphenyl)-(1,1'-biphenyl)-4,4'-diamine yields an ambipolar imaging member, the imaging sign depending on the sign of the charge: sign-retaining or sign reversing images being obtained with negative or positive charge, respectively.

EXAMPLE III

A fresh imaging member was prepared as described in Example I. The resulting migration imaging member was thereafter imaged and developed by a combination of vapor and heat processing techniques comprising the steps of pretreating the member by uniform exposure to n-ethyl acetate vapor in a vapor chamber for about one half minute, immediately corotron charging to a surface potential of about +180 volts, exposing to activating radiation through a step-wedge, and developing by heating to about 115° C. for about 5 seconds on a hot plate in contact with the Mylar. The resulting sign-reversed imaged migration imaging member exhibited excellent image quality and a contrast density of about 1.30. $D_{max}$ was about 1.90 and the $D_{min}$ was about 0.60. The $D_{max}$ region (light exposed) was due to the unmigrated selenium particles and the $D_{min}$ region (unexposed) was due to the migrated selenium particles dispersed in the polymer matrix. It was also found that the relatively low $D_{min}$ was due to slight agglomeration of the selenium particles in the $D_{min}$ regions of the image.

EXAMPLE IV

The procedures of Example III were repeated with identical materials except that the time interval between vapor pretreatment and charging was extended to about one half hour before charging. Results identical to those described in Example III were achieved.

EXAMPLE V

The procedures of Example III were repeated with identical materials except that 1,1,1-trichloroethane was substituted for the n-ethyl acetate solvent vapor. Results identical to those described in Example III were achieved.

EXAMPLE VI

An imaging member similar to that illustrated in FIG. 2 was prepared by dissolving about 13 percent by weight of 80/20 mole percent copolymer of styrene and hexylmethacrylate and about 1.0 percent by weight of N,N'-diphenyl-N,N'-bis(3''-methylphenyl)-(1,1'-biphenyl)-4,4'-diamine in about 86 percent by weight toluene all based on the total weight of the solution. The solution was applied by means of a Dilts coater onto a 12 inch wide 3 mil Mylar polyester film (available from E. I. duPont deNemours Co.) having a thin, semitransparent aluminum coating. The deposited softenable layer was allowed to dry at about 115° C. for about 15 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting imaging member had a very uniform optical density about 1.92 with no signs of microcrystals or aggregates. A coating solution of about 0.5 percent by weight of low molecular weight polydimethylsiloxane (PANAX 31, available from Bard Laboratories, Inc.) in isopropanol was applied to the imaging member by means of a No. 14 draw rod and dried at about 70° C. for about 5 minutes to form an exceedingly thin overcoating. The resulting migration imaging member was thereafter imaged and developed by heat processing techniques comprising the steps of corotron charging to a surface potential of about +180 volts, exposing to activating radiation through a step-wedge and developing by heating to about 115° C. for about 5 seconds on a hot plate in contact with the Mylar. Contrast density of the resulting sign-reversed imaged migration imaging member was greater than about 1.1. The imaged member exhibited good abrasion resistance when scraped with a finger nail and good finger print resistance when attempts were made to apply fingerprints to the imaging member before and after imaging. The migration imaging member also retained its integrity when subjected to a moderately severe adhesive-tape test with Scotch brand "Magic" adhesive tape.

EXAMPLE VII

The procedures of Example VI were repeated with identical materials except that the migration imaging member was developed with vapor instead of heat. Thus the migration imaging member was imaged and developed by vapor processing techniques comprising the steps of corotron charging to a surface potential of about +180 volts, exposing to activating radiation through a step-wedge and developing by toluene vapor as described in Example I. Contrast density of the resulting sign-reversed imaged migration imaging member was greater than about 1.1. The overcoated imaged member exhibited good abrasion resistance when scraped with a finger nail and good finger print resistance when attempts were made to apply fingerprints to the imaging member before and after imaging. The migration imaging member also retained its integrity when subjected to a moderately severe adhesive-tape test with Scotch brand "Magic" adhesive tape.

EXAMPLE VIII

The procedures of Example VI were repeated with identical materials except that the migration imaging member was charged to a surface potential of about −80 volts instead of +180 volts. Contrast density of the resulting sign-retained imaged migration imaging member was greater than about 1.1. The ambipolar overcoated imaged member had high contrast densities and good image quality when positively or negatively charged and exhibited good abrasion resistance when scraped with a finger nail and good finger print resistance when attempts were made to apply fingerprints to the imaging member before and after imaging. The migration imaging member also retained its integrity when subjected to a moderately severe adhesive-tape test with Scotch brand "Magic" adhesive tape.

EXAMPLE IX

The procedures of Example VII were repeated with identical materials except that the migration imaging member was charged to a surface potential of about −80 volts instead of +180 volts. Contrast density of the resulting sign-retained imaged migration imaging member was greater than about 1.1. The ambipolar overcoated imaged member had high contrast densities and good image quality when positively or negatively charged and exhibited good abrasion resistance when scraped with a finger nail and good finger print resistance when attempts were made to apply fingerprints to the imaging member before and after imaging. The migration imaging member also retained its integrity when subjected to a moderately severe adhesive-tape test with Scotch brand "Magic" adhesive tape.

EXAMPLE X

An imaging member similar to that illustrated in FIG. 2 was prepared by dissolving about 13 percent by weight of 80/20 mole percent copolymer of styrene and hexylmethacrylate and about 1.0 percent by weight of N,N'-diphenyl-N,N'-bis(3''-methylphenyl)-(1,1'-biphenyl)-4,4'-diamine in about 86 percent by weight toluene all based on the total weight of the solution. The solution was applied by means of a Dilts coater onto a 12 inch wide 3 mil Mylar polyester film (available from E. I. duPont deNemours Co.) having a thin, semi-transparent aluminum coating. The deposited softenable layer was allowed to dry at about 115° C. for about 2 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting imaging member had a very uniform optical density of about 1.92 and with no signs of microcrystals or aggregates. A coating solution was prepared of about 0.25 percent by weight of low molecular weight polydimethylsiloxane (PANAX 31, available from Bard Laboratories, Inc.) and about 1.0 percent by weight of poly(vinyltoluene) resin (Pliolite OMS, available from Goodyear Tire & Rubber Co.) and about 99 percent by weight Freon TF, (available from E. I. duPont de Nemours & Co.). The resulting coating solution was applied to the imaging member by means of a size 14 Mayer rod and dried at about 70° C. for about 5 minutes to form an overcoating having a thickness of about 0.5 micrometer. The resulting overcoated migration imaging member was uniformly coated with no observable spots. The role of the Pliolite OMS resin appears to be that of a very thin polymeric binder which enhances the abrasion resistance of the softenable layer and also the wetting of the softenable layer. The imaging member was thereafter imaged and developed by heat processing techniques comprising the steps of corotron charging to a surface potential of about +180 volts, exposing to activating radiation through a step-wedge and developing by heating to about 115° C. for about 5 seconds on a hot plate in contact with the Mylar. Contrast density of the imaged member was greater than about 1.1 and resolution was about 45 line pairs per millimeter. The overcoated imaged sign-reversed member exhibited greater abrasion resistance when scraped with a finger nail than the member described in Example VI and very good finger print resistance when attempts were made to apply fingerprints to the imaging member before and after imaging. The migration imaging member also retained its integrity when subjected to a severe adhesive-tape test with Scotch brand "Magic" adhesive tape.

EXAMPLE XI

An imaging member similar to that illustrated in FIG. 2 was prepared by dissolving about 13 percent by weight of 80/20 mole percent copolymer of styrene and hexylmethacrylate and about 1.0 percent by weight of N,N'-diphenyl-N,N'-bis(3''-methylphenyl)-(1,1'-biphenyl)-4,4'-diamine in about 86 percent by weight toluene all based on the total weight of the solution. The solution was applied by means of a Dilts coater onto a 12 inch wide 3 mil Mylar polyester film (available from E. I. duPont deNemours Co.) having a thin, semi-transparent aluminum coating. The deposited softenable layer was allowed to dry at about 115° C. for about 15 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting imaging member had a very uniform optical density of about 1.92 with no signs of microcrystals or aggregates. A coating solution of about 0.5 percent by weight of low molecular weight polydimethylsiloxane (PANAX 31, available from Bard Laboratories, Inc.) in isopropanol was applied to the imaging member by means of a No. 14 draw rod and dried at about 70° C. for about 5 minutes to form an exceedingly thin overcoating. The resulting migration imaging member was thereafter imaged and developed by a combination of vapor and heat processing techniques comprising the steps of pretreating the member by uniform exposure to n-ethyl acetate vapor in a vapor chamber for about one half minute, immediately corotron charging to a surface potential of about +180 volts, exposing to activating radiation through a step-wedge, and developing by heating to about 115° C. for about 5 seconds on a hot plate in contact with the Mylar. The resulting sign-reversed imaged migration imaging member exhibited excellent image quality and a contrast density greater than about 1.1. The imaged member exhibited good abrasion resistance when scraped with a finger nail and good finger print resistance when attempts were made to apply fingerprints to the imaging member before and after imaging. The migration imaging member also retained its integrity when subjected to a moderately severe adhesive-tape test with Scotch brand "Magic" adhesive tape.

EXAMPLE XII

A fresh imaging member was prepared as described in Example I. The resulting migration imaging member was thereafter imaged and developed by heat processing techniques comprising the steps of corotron charging the imaging member to a surface potential of about +180 volts, exposing to activating radiation through a step-wedge, and developing by heating to about 115° C. for about 5 seconds on a hot plate in contact with the Mylar. The resulting migration imaging member in this control experiment exhibited no change in optical density. In other words, the optical density of the entire member was about 1.90, i.e. equal to $D_{max}$. This seems to suggest that this type of unovercoated imaging member is undesirable for migration imaging using positive charging and heat development.

EXAMPLE XIII

A fresh imaging member was prepared as described in Example I. The resulting migration imaging member was thereafter imaged and developed by heat processing techniques comprising the steps of corotron charging the imaging member to a surface potential of about −80 volts, exposing to activating radiation through a step-wedge, and developing by heating to about 115° C. for about 5 seconds on a hot plate in contact with the Mylar. An image a contrast density of about 1.2 ($D_{max}$ about 1.90, $D_{min}$ about 0.7) was obtained. In contrast to the results of control Example XI this type of unovercoated imaging member is desirable for migration imaging processes using negative charging and heat development.

Other modifications of the present invention will occur to those skilled in the art based upon a reading of the present disclosure. These are intended to be included within the scope of this invention.

I claim:

1. A migration imaging member comprising a substrate and an electrically insulating softenable layer on said substrate, said softenable layer comprising a charge transport molecule and a fracturable particulate layer of electrically photosensitive migration marking material located substantially at or near the surface of said softenable layer spaced from said substrate, said charge transport molecule being predominantly nonabsorbing in the spectral region at which said electrically photosensitive migration marking material photogenerates charge carriers, being capable of increasing charge injection from said electrically photosensitive migration marking material to said softenable layer and being dissolved or molecularly dispersed in said softenable layer.

2. A migration imaging member in accordance with claim 1 wherein said softenable layer comprises about 2 percent to about 50 percent by weight of said charge transport molecule based on the total weight of said softenable layer.

3. An imaging method in accordance with claim 1 wherein said substrate is electrically conductive.

4. An imaging method in accordance with claim 1 wherein said fracturable layer is a monolayer.

5. A migration imaging member comprising a substrate and an electrically insulating softenable layer on said substrate, said softenable layer comprising a substituted, unsymmetrical tertiary amine charge transport molecule and a fracturable layer of electrically photosensitive migration marking material located substantially at or near the surface of said softenable layer spaced from said substrate, said charge transport molecule being predominantly nonabsorbing in the spectral region at which said electrically photosensitive migration marking material photogenerates charge carriers, being capable of increasing charge injection from said electrically photosensitive migration marking material to said softenable layer and being dissolved or molecularly dispersed in said softenable layer.

6. A migration imaging member in accordance with claim 5 wherein said substituted, unsymmetrical tertiary amine is one having the general formula:

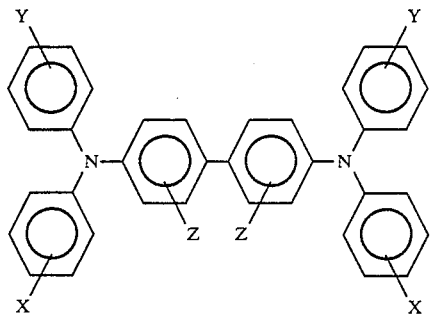

wherein X, Y and Z are selected from the group consisting of hydrogen, an alkyl group having from 1 to about 20 carbon atoms and chlorine, and at least one of X, Y and Z are independently selected from the group consisting of an alkyl group having from 1 to about 20 carbon atoms and chlorine.

7. A migration imaging member comprising a substrate, an electrically insulating, softenable layer on said substrate, and a protective overcoating comprising a film forming resin, said softenable layer comprising a charge transport molecule and a fracturable layer of electrically photosensitive migration marking material located substantially at or near the surface of said softenable layer spaced from said substrate, said charge transport molecule being predominantly nonabsorbing in the spectral region at which said electrically photosensitive migration marking material photogenerates charge carriers, being capable of increasing charge injection from said electrically photosensitive migration marking material to said softenable layer and being dissolved or molecularly dispersed in said softenable layer.

8. An imaging member in accordance with claim 7 wherein said fracturable layer is a monolayer.

9. An imaging method comprising providing a migration imaging member comprising a substrate, and an electrically insulating softenable layer on said substrate, said softenable layer comprising a charge transport molecule and a fracturable layer of electrically photosensitive migration marking material located substantially at or near the surface of said softenable layer spaced from said substrate, said charge transport molecule being predominantly nonabsorbing in the spectral region at which said electrically photosensitive migration marking material photogenerates charge carriers, being capable of increasing charge injection from said electrically photosensitive migration marking material to said softenable layer and being dissolved or molecularly dispersed in said softenable layer, electrostatically charging said member to deposit a uniform charge on said member, exposing said member to activating radiation in an imagewise pattern prior to substantial decay of said uniform charge and developing said member by decreasing the resistance to migration of marking material in depth in said softenable layer at least sufficient to allow migration of marking material whereby marking material migrates toward said substrate in image configuration.

10. An imaging method in accordance with claim 9 including decreasing said resistance to migration of marking material in depth in said softenable layer by heat softening said softenable layer.

11. An imaging method in accordance with claim 9 including decreasing said resistance to migration of marking material in depth in said softenable layer by solvent softening said softenable layer.

12. An imaging method in accordance with claim 11 wherein said solvent is a vapor.

13. An imaging method in accordance with claim 10 including exposing said softenable layer to solvent vapor prior to said charging of said member.

14. An imaging method in accordance with claim 9 wherein said fracturable layer is a monolayer.

* * * * *